United States Patent [19]

Heard

[11] Patent Number: 4,705,253

[45] Date of Patent: Nov. 10, 1987

[54] OFFSET SIGN MOUNTING

[75] Inventor: Robert A. H. Heard, Backwell, England

[73] Assignee: Signfix Limited, Backwell, England

[21] Appl. No.: 739,194

[22] Filed: May 30, 1985

[30] Foreign Application Priority Data

Jun. 1, 1984 [GB] United Kingdom ..... 8414037

[51] Int. Cl.[4] ..... G09F 15/00

[52] U.S. Cl. ..... 248/219.4; 248/231; 248/231.1; 40/607

[58] Field of Search ..... 248/219.1–219.4, 248/218.4, 228, 230, 500, 231.9, 223.4, 224.1, 224.2, 224.4, 231, 231.1, 71, 72, 73; 40/607

[56] References Cited

U.S. PATENT DOCUMENTS

| | | | |
|---|---|---|---|
| 1,742,450 | 1/1930 | Riemenschneider | 248/231 |
| 3,012,250 | 12/1961 | Morris | 248/231.1 |
| 3,046,040 | 7/1962 | Luper | 248/230 |
| 3,241,800 | 3/1966 | Richter | 248/231.1 |
| 3,414,219 | 12/1968 | Siegel | 248/207 |
| 3,529,798 | 9/1970 | Williams | 248/223.4 |
| 3,595,512 | 7/1971 | Enblom | 248/230 |
| 3,612,460 | 10/1971 | Smith | 248/231 |
| 3,958,351 | 5/1976 | Summey | 248/230 |
| 4,101,191 | 7/1978 | Gould | 248/230 |

FOREIGN PATENT DOCUMENTS

| | | | |
|---|---|---|---|
| 2045044 | 9/1970 | Fed. Rep. of Germany | 248/558 |
| 2021390 | 12/1979 | United Kingdom | 248/219.4 |

*Primary Examiner*—Reinaldo P. Machado
*Assistant Examiner*—Alvin Chin-Shue
*Attorney, Agent, or Firm*—William R. Hinds

[57] ABSTRACT

An offset sign is mounted to a supporting post by means of brackets top and bottom. Each bracket has a horizontal plate which is secured to the edge of the sign and a first transverse channel at one end of the plate, the mouth of the channel providing edges which abut the post. A second channel is provided back-to-back with the first channel to receive either a tensile strap passed around the post, or else a bar with a threaded hole in which is engaged a threaded rod extending through the common web between the channels and through the post itself.

11 Claims, 5 Drawing Figures

OFFSET SIGN MOUNTING

This invention relates to the offset mounting of signs on a supporting post.

Offset signs are frequently required, for example for street signs, bus stops and the like, direction indicators etc. One of the problems with offset signs, particularly those which are radially elongate with respect to the supporting post, is that they are liable to deformation and damage as a result of the large bending and turning moments and the high cantilever forces which can be applied to the sign. Various mounting devices have been devised in the past, with varying degrees of success. One such mounting is provided by my earlier invention, as described in GB No. 2021390 and U.S. Pat. No. 4,341,029. However, in some localities, a variety of different types of post are used, and in particular wooden posts are quite frequently used. These provide particular problems in relation to seasonal expansion and contraction which make secure mounting difficult by conventional means such as strapping tightened around the post. The usual way of mounting signs to a wooden post is to bolt them to the post by means of a screw passing right through the post.

It is an object of the present invention to provide a mounting for an offset sign which has versatility making it suitable for use with both wooden posts and metal posts.

According to the present invention there is provided a bracket for mounting an offset sign to a supporting post, the bracket comprising an elongate plate for attachment to the sign and first channel means at one end of the plate extending transversely of the direction of elongation of the plate and opening in the opposite direction from the plate, said first channel means having parallel walls presenting edges for abutment with a said post, the walls being joined by a web which is pierced by an opening, the side of the web remote from said first channel means being arranged to provide a second channel means having a mouth restricted by mutually inturned lips and opening in the direction of elongation of said plate. Preferably said aperture is provided centrally of said web. In one form, three said parallel walls are provided in said first channel means, the central wall being interrupted in the region of said aperture. A separate bar may be provided located in said second channel means so as to be retained therein by said inturned lips and having a threaded aperture registrable with said aperture in said web, and an externally threaded rod inserted through said aperture in said web and threadedly engaging said aperture in said bar and projecting from said first channel means in the direction opposite that of said plate. A said lip of the mouth of said second channel means preferably provides an obstruction to the adjacent end of said threaded rod, limiting the extent to which the rod can be screwed through said bar.

The invention will also provide signs supported by the brackets hereof, and methods of mounting offset signs to supporting posts.

In order that the invention may be more clearly understood, various embodiments will now be described with reference to the accompanying drawings, wherein.

Figure 1:
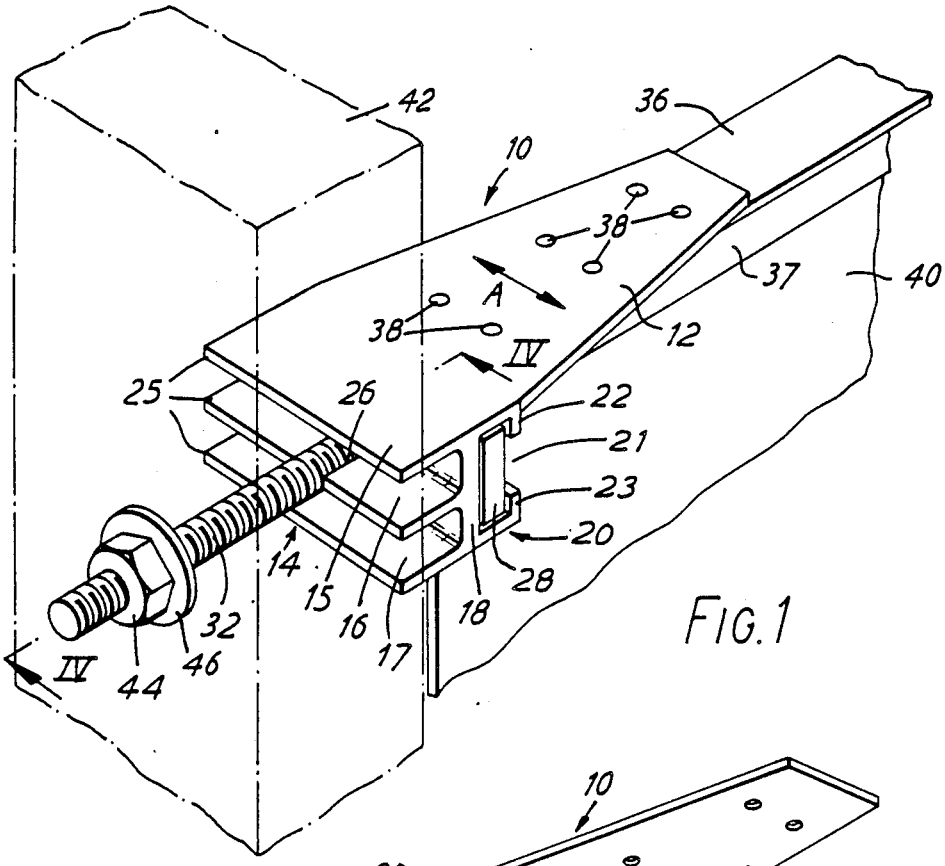
FIG. 1 shows a perspective view of a first embodiment of bracket in use.
Figure 2:
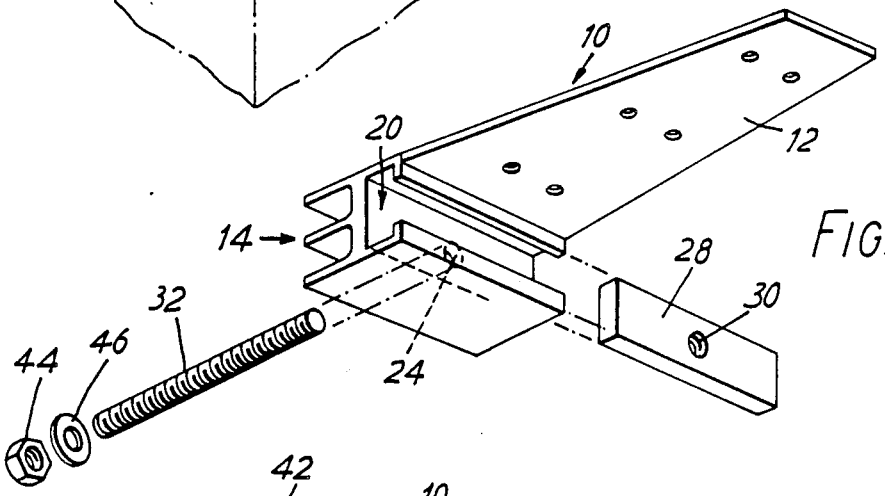
FIG. 2 shows an exploded perspective view of the bracket.
Figure 3:
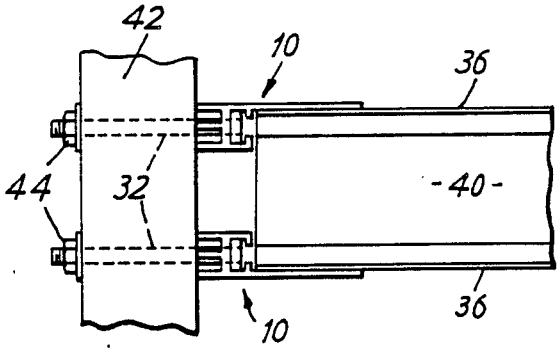
FIG. 3 shows a side view of a sign supported by a pair of brackets as in FIG. 1.
Figure 4:
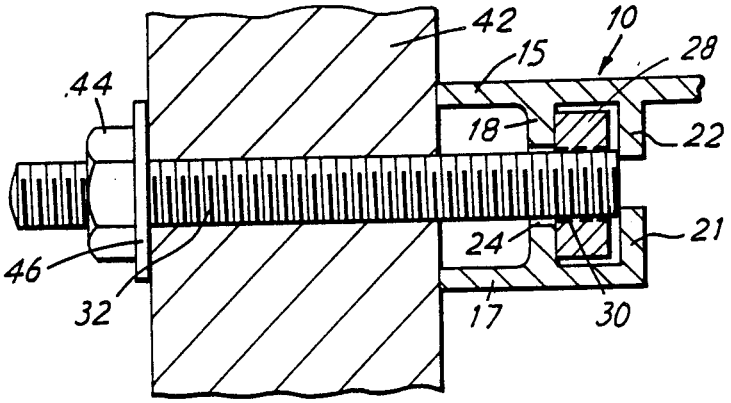
FIG. 4 shows a cross-sectional view on the line IV—IV of FIG. 1.

Referring to the drawings and firstly to FIGS. 1 to 4; the bracket 10 comprises an elongate plate 12 having at one end first channel means 14 disposed to one side of the plane of the plate. The first channel means comprises three parallel walls 15,16,17, joined by a web 18. On the side of the web remote from the first channel means there is provided a second channel means 20, having a mouth 21 restricted by inturned lips 22,23. The web 18 is provided with a central aperture 24 (see FIGS. 2 and 4), and the central wall 16 of the first channel means is interrupted 26 in the region of the opening 24. A bar 28 is a sliding fit in the second channel means 20, and is retained therein by the lips 22,23. The bar 28 has a central opening 30 which is internally screw threaded. The bar is the same length as the channel 20, and the aperture 30 is arranged so that when the ends of the bar 28 are flush with the ends of the channel 20, the aperture 30 is in register with the aperture 24 in the web 18. In this condition an externally screw threaded rod 32 can be introduced through the interruption 26 in the wall 16 and through the aperture 24 in the web 18 and screwed into the threaded aperture 30 in the bar 28. As can be seen from FIG. 4, the lips 21,23 of the second channel 20 restrict the mouth of the channel 20 to a width less than the diameter of the rod 32, thereby limiting the extent to which the rod can be screwed through the bar 28. In this condition, the rod projects from the first channel means 14 in the direction opposite that of the plate 12, as can be seen in FIGS. 1 and 4.

In use, a pair of brackets 10 are employed to mount the sign. To the plate 12 of each bracket is secured an elongate reinforcing member 36, preferably of T-section, the top of the T being for example rivetted 38 to the plate 12. The reinforcing member 36 extends from the bracket in the longitudinal direction of the plate 12, and a sign plate 40 is secured to the leg of the T, for example also by rivetting. Thus, as can be seen from FIG. 3, the sign plate has reinforcing members 36 extending along top and bottom edges, with the brackets 10 at one end of the plate. The threaded rods are inserted through prepared holes formed in a supporting post 42, the length of the rods being sufficient so that when the edges 25 of the plates 15,16,17 abut the post, the rods project from the opposite side of the post, and can be retained and tightened thereon by nuts 44 and washers 46.

Figure 5:
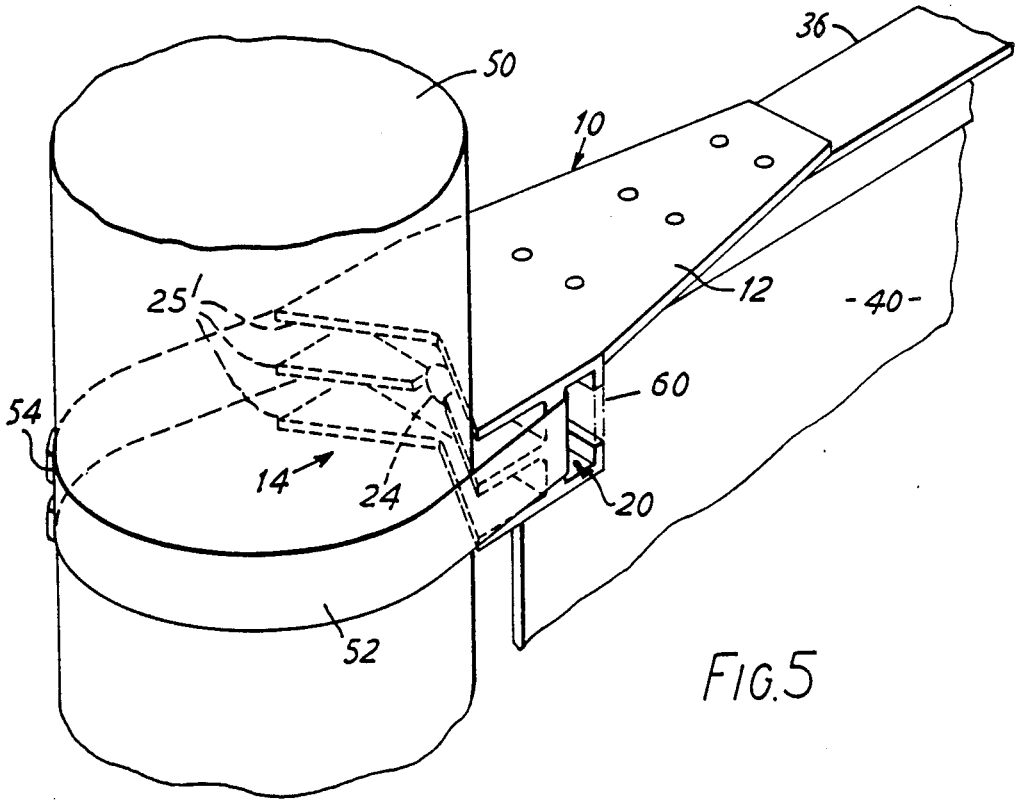
FIG. 5 shows a perspective view of another embodiment of bracket in use.

FIG. 5 shows an alternative embodiment of bracket, which is similar to the bracket described in FIGS. 1 to 4, except that the walls 15,16,17, instead of having straight edges 25 have V-profile edges 25'. These are suitable for abutting a circular post, and in particular will readily seat against posts of widely varying diameters. However, this embodiment of bracket could also be used with wooden posts 42, in the manner described with reference to FIGS. 1 to 4, the only difference being that the edges 25' will not seat wholly against the surface of the post, but instead the acute angles formed by the edges 25' at the extreme ends of the walls will tend to bite into the wood of the post. This may in fact be a positive advantage in some instances, since it could give additional security against the sign collapsing if the securing becomes slightly loose in use, for example through expansion and contraction of the wood.

FIG. 5, however, illustrates this embodiment of bracket in use with a circular post 50. The bracket could be mounted to that circular post by means of a rod 32 passing through prepared holes in the post. However, in the embodiment illustrated the bracket is held to the post by means of a strap 52, suitably of high tensile stainless steel. Here, the bar 28 is omitted, and instread the strap 52 extends through the second channel 20, and is passed around the post, tightened and secured by a conventional buckle 54. This strapping method of attaching the bracket to a post is more suitable for metal posts which are not liable to appreciable expansion and contraction in the same way as wooden posts. It will be appreciated that if the metal post is of a rectangular cross-section, then it may be more appropriate to use the bracket of FIGS. 1 and 2, with the bar 28 and rod 32 omitted, and instead replaced by a strapping 52.

Thus, the present invention provides a form of bracket which is simple to use and versatile, in that it can be used for a wide variety of situations in mounting offset signs. It is only necessary to provide a series of brackets, some separate bars 28 and rods 32 with appropriate nuts and washers, and also some conventional strapping 52, and the sign erector can readily choose the system most appropriate for the particular sign in question. He does not even need to prepare for the particular sign until he gets out on site. For example, the sign plate may have the reinforcing members 36 and brackets 10 fitted to it in the workshop, and then the erector goes out on site, taking with him some bars 28, rods 32 with their nuts and washers, and strapping 52, and then uses whichever is appropriate, depending upon the nature of the post with which he is dealing. As has already been indicated, either of the embodiments of FIGS. 1 and 5 could be used with any type of post, although there is likely to be some preference for one or other edge profile 25, 25'.

The bracket can be suitably extruded from aluminium, extruded in the direction indicated by the arrows A in FIG. 1. The extrusion will be cut at intervals according to the length of the bracket at its widest portion (in the region of the channels), and the plate 12 can be cut with a taper as indicated, for aesthetic reasons, if desired. The aperture 24 will then be drilled, and the edges of the walls 15 to 17 machined with a V-profile if desired.

The central wall 16 could be omitted if desired. Also, instead of having an open mouth to the second channel 20, it could be a closed box section channel, as indicated at 60 in FIG. 5. An open mouth channel would normally be preferred for reasons of ease of manufacture.

I claim:

1. A bracket for mounting an offset sign to a supporting post, the bracket comprising an elongate plate for extending lengthwise of and for attachment to an upper or lower edge of the sign, first channel means integral with and at one end of the plate and extending transversely of the direction of elongation of the plate for seating against the post with the plane of the plate normal to the axis of the post, said first channel means having parallel walls presenting surfaces for abutment with a said post, the walls being joined by a web which is pierced by an aperture, the side of the web remote from said first channel means being arranged to provide a second open-ended channel means opposite said web, the second channel means extending in a direction parallel to the plane of the plate and transverse to the length of the plate, said second channel means including second wall means opposite said web, whereby said second channel means can alternatively receive a tensile strap passing around the post or a bar having a threaded aperture in register with said aperture in said web and engaged by an externally threaded rod inserted through the aperture in said web, said second wall means providing an obstruction to the adjacent end of said threaded rod, limiting the extent to which the rod can be screwed through said bar.

2. A bracket according to claim 1 wherein said aperture in said web is provided centrally of said web.

3. A bracket according to claim 1 wherein three said parallel walls are provided in said first channel means, the central wall being interrupted in the region of said aperture in said web.

4. A bracket according to claim 1 wherein said second channel means has a mouth restricted by mutually inturned lips comprising said second wall means and opening in the direction of elongation of said plate, and wherein a separate bar is provided located in said second channel means so as to be retained therein by said inturned lips and having a threaded aperture registrable with said aperture in said web, and an externally threaded rod is provided inserted through said aperture in said web and threadedly engaging said aperture in said bar and projecting from said first channel means in the direction opposite that of said plate.

5. A sign construction comprising a sign panel secured at opposite edges to elongate plates of a pair of brackets according to claim 1, said parallel walls of said first channel means being in edgewise abutment with a supporting post, and means for clamping the brackets to the post in said abutment condition.

6. A sign construction according to claim 5 wherein each said clamping means takes the form of a band of tensile material extending through said second channel means and tightened around the post.

7. A sign construction according to claim 5 wherein each said clamping means takes the form of a threaded rod extending through said aperture in said web and engaged at one end thereof in a threaded aperture in a bar located in said second channel means, the other end of the rod extending from said first channel means through the supporting post and tightened against the post on the side thereof remote from the bracket.

8. A bracket as claimed in claim 1 wherein said first and second channel means extend generally parallel to each other along opposite sides of said web and generally parallel to but offset from the plane of said elongate plate.

9. A bracket as claimed in claim 8 wherein said parallel walls of said first channel means extend transversely of the post axis when mounted thereon with said surfaces in abutment therewith.

10. A bracket as claimed in claim 9 wherein some of the walls of said second channel means are coplanar extensions of the parallel walls of said first channel means.

11. A bracket for mounting an offset sign to a supporting post, the bracket comprising an elongate plate for extending partially along and for attachment to an upper or lower edge of the sign, and first channel means integral with and at one end of the plate and extending transversely of the direction of elongation of the plate for seating against the post with the plane of the plate normal to the axis of the post, said first channel means having parallel walls presenting edges for abutment with said post, the walls being joined by a web which is pierced by an opening, the side of the web remote from said first channel means being arranged to provide a second channel means opposite said web, said second channel means having a mouth restricted by mutually inturned lips and opening in the direction of elongation of said plate away from the post, and wherein a separate bar is provided located in said second channel means so as to be retained therein by said inturned lips and having a threaded aperture registrable with said opening in said web, and an externally threaded rod is provided inserted through said opening in said web and threadedly engaging said aperture in said bar and projecting from said first channel means in the direction opposite that of said plate, a said lip of the mouth of said second channel means providing an obstruction to the adjacent end of said threaded rod, limiting the extent to which the rod can be screwed through said bar.

* * * * *